US006394482B1

(12) United States Patent
Carlson

(10) Patent No.: US 6,394,482 B1
(45) Date of Patent: May 28, 2002

(54) SNOW SKIS HAVING ASYMMETRICAL EDGES

(75) Inventor: Scott R. Carlson, Dillon, CO (US)

(73) Assignee: Ski Logic, LLC, Denver, CO (US)

( * ) Notice: Subject to any disclaimer, the term of this patent is extended or adjusted under 35 U.S.C. 154(b) by 0 days.

(21) Appl. No.: 09/626,318

(22) Filed: Jul. 25, 2000

Related U.S. Application Data

(60) Provisional application No. 60/152,981, filed on Sep. 9, 1999.

(51) Int. Cl.[7] ..... A63C 5/00

(52) U.S. Cl. ..... 280/601; 280/609; 280/608

(58) Field of Search ..... 280/601, 603, 280/607, 608, 609

(56) References Cited

U.S. PATENT DOCUMENTS

| | | | | |
|---|---|---|---|---|
| 4,377,297 A | | 3/1983 | Staufer | |
| 4,688,821 A | | 8/1987 | Meatto et al. | |
| 4,700,967 A | | 10/1987 | Meatto et al. | 280/609 |
| 4,705,291 A | | 11/1987 | Gauer | |
| 4,715,612 A | | 12/1987 | Fels et al. | 280/609 |
| 4,869,523 A | * | 9/1989 | Diard et al. | 280/609 |
| 4,895,388 A | | 1/1990 | Richmond | |
| 4,971,349 A | * | 11/1990 | Diard et al. | 280/609 |
| 4,971,350 A | | 11/1990 | Fagot | |
| 5,018,760 A | * | 5/1991 | Remondet | 280/609 |
| 5,301,965 A | | 4/1994 | Floreani | |
| 5,405,161 A | | 4/1995 | Petkov | |
| 5,553,884 A | * | 9/1996 | Abondance | 280/609 |
| 5,603,522 A | | 2/1997 | Nelson | |
| 5,618,053 A | * | 4/1997 | Moelg et al. | 280/609 |
| 5,649,722 A | | 7/1997 | Champlin | |
| 5,782,475 A | | 7/1998 | Balmain | 280/14.2 |
| 5,823,562 A | * | 10/1998 | Stubblefield | 280/609 |
| 5,876,056 A | | 3/1999 | Karlsen | |
| 5,984,324 A | | 11/1999 | Wariakois | |
| 6,000,711 A | * | 12/1999 | Fey et al. | 280/603 |

OTHER PUBLICATIONS

Bill Grout, "Open the Toy Box," Skiing Trade News, Jan., 1997, p. 20.

Greg Johnston, "All Aboard! Ski and Snowboard Design Rides the Boom into the Backcountry," Seattle Post–Intelligencer, Oct. 23, 1997, p. 8.

Bill Grout, "Arc Angles: We Test Some Skis You Can Bank On," Skiing, Dec., 1997, p. 108, vol. 49, No. 4.

Peter Oliver & Michael Miracle, "Inbounds Adventure," Skiing, Sep., 1998, p. 124, vol. 51, No. 1.

Bill Grout, "A Slice of Heaven," Skiing, Nov., 1998, p. 156, vol. 51, No. 3.

* cited by examiner

*Primary Examiner*—J. J. Swann
*Assistant Examiner*—J. Allen Shriver
(74) *Attorney, Agent, or Firm*—Holland & Hart LLP

(57) ABSTRACT

Snow skis having asymmetrical edges to make turning easier while telemark or alpine skiing. Each ski has concave, curved lateral edges. These lateral edges are asymmetrical, in that the medial edge of each ski is substantially longer than its outer edge. In addition, the point of maximum side cut on the outer edge is adjacent to the toe area of the skiers boot, while the point of maximum side cut on the medial edge is adjacent to the middle of the ski boot to facilitate easier turns while telemark skiing.

59 Claims, 3 Drawing Sheets

202
102
215
125
250
225
150
115
220
210
120
110
200
100
201
101
$L_O$
$L_I$

ACTIVE EDGE
ACTIVE EDGE
200
100
220
225
250
260
215
210
125
160
150
115
120
110

ACTIVE EDGE
ACTIVE EDGE
200
100
220
225
250
260
215
210
125
160
150
115
120
110

SNOW SKIS HAVING ASYMMETRICAL EDGES

RELATED APPLICATION

The present application is based on the Applicant's U.S. Provisional Patent Application Ser. No. 60/152,981, entitled "Telemark Ski," filed on Sep. 9, 1999.

BACKGROUND OF THE INVENTION

1. Field of the Invention

The present invention relates generally to the field of snow skis. More specifically, the present invention discloses snow skis having asymmetrical lateral edges.

2. Conventional Types of Skis

A variety of types of skis are currently in use. The present invention is intended primarily for telemark skiing, although it can be readily adapted for other types of skis, including the following types of skis in common use:

The "alpine ski", or fixed heel ski, is characterized by its utilization rather than its design. The binding by which a skier's boot is attached to the ski secures both the toe and heel of the ski boot to the ski simultaneously. This method of binding characterizes the use of this ski as "alpine." In alpine skiing, both skis are generally maintained parallel to one another. The skier turns by shifting weight to the medial edge of the outside ski (i.e., the ski farther from the center of the circle describing the turn).

The "telemark ski", or free heel ski, is similarly characterized by its utilization rather than its design. The binding by which the skier's boot is attached to the ski causes only the toe component of the ski boot to be fixed to the ski, while leaving the heel free to rise off the ski. Other than the binding, the ski is essentially the same as an alpine ski. Turning in telemark skiing is quite different than in alpine skiing. The skier positions the inside ski (i.e., the ski closer to the center of the circle describing the turn) behind the outside ski, so that the heel of the inside boot is raised off the inside ski. Any pressure applied by the skier to the inside ski is exerted via the toe area of the boot (i.e., the general area between the ball of the skier's foot to the lip of the boot). In contrast, the outside boot remains flat against the outside ski, so that pressure is exerted on the ski over the entire area of the ski boot. When the inside boot is raised and the outside boot remains flat, a "telemark posture" is attained.

In telemark skiing, the points of applied pressure (resulting from the skier's application of weight and resulting additional forces) exist at different locations along the longitudinal axes of each ski. The inside ski (i.e., the ski closer to the center of the circle describing the turn) receives the application of pressure at the toe area of the attached boot. The outside ski receives the application of pressure along the entire bottom of the boot's sole.

The "active edge" refers to the edge of each ski closer to the center of the turn being executed, i.e., the inside edge of the turn. By tilting the ski and applying pressure on the active edge, the active edge of each ski engages the underlying snow surface causing the ski to turn.

The "cross-country ski" is similar to the telemark ski, except that it is designed for flatter terrain. Cross-country skis tend to be narrower and lighter than telemark skis.

The "randonée ski" is a hybrid of free heel and fixed heel skis, wherein the heel binding can either be fixed or free at the option of the skier.

3. Prior Art

The prior art in the field includes the following:

| Inventor | Patent No. | Issue Date |
|---|---|---|
| Staufer | 4,377,297 | Mar. 22, 1983 |
| Meatto et al. | 4,688,821 | Aug. 25, 1987 |
| Gauer | 4,705,291 | Nov. 10, 1987 |
| Fagot | 4,971,350 | Nov. 20, 1990 |
| Floreani | 5,301,965 | Apr. 12, 1994 |
| Petkov | 5,405,161 | Apr. 11, 1995 |
| Nelson | 5,603,522 | Feb. 18, 1997 |
| Karlsen | 5,876,056 | March 2, 1999 |
| Richmond | 4,895,388 | Jan. 23, 1990 |

"Open the Toy Box," *Skiing Trade News*, page 20 (January, 1997)

"All Aboard! Ski and Snowboard Design Rides the Boom into the Backcountry," *Seattle Post-Intelligencer, Getaways*, page 8 (Oct. 23, 1997)

"Arc Angles: We Test Some Skis You Can Bank On," *Skiing*, page 108 (vol. 49, no. 4, December 1997)

"Inbounds Adventure," *Skiing*, page 124 (vol. 51, no.1, September 1998)

"A Slice of Heaven," *Skiing*, page 156 (vol. 51, no. 3, November 1998)

The article from *Skiing Trade News* mentions and shows a picture of the "Radarc" skis introduced by Fischer GmBH of Austria. The articles from the *Seattle Post-Intelligencer* and *Skiing* also describe the Fischer Radarc skis. The Fischer Radarc skis have asymmetrical side cuts with the longer edges on the outside of the skis, which is opposite from the present invention. The side cut on the outer edge is shifted farther bask toward the tail of the ski than the side cut on the inside edge. This arrangement is also backward from the present invention. It appears that the Radarc ski is intended for a specialized style of alpine skiing known as "carving", in which the skier's legs are spread apart and turns are made by exerting substantially equal force on the active edges of both skis. The active edges make substantially concentric circles for both skis. Therefore, since the outside ski turns with a larger radius than the inside ski when carving, it may be advantageous for the medial edge of the outside ski to have a larger radius than the lateral edge of the inside ski. However, it should be expressly understood that the Radarc ski addresses a completely different problem and teaches away from the present invention.

Meatto et al. disclose asymmetrical alpine skis with offset boot platforms. The medial edges of the skis have side cuts but the outer edges are substantially straight.

Fagot discloses an alpine ski with a symmetrical bottom surface, but having asymmetrical, inwardly sloping sidewalls.

Gauer discloses a short symmetrical alpine ski that is convex from front to rear, and also convex from side to side.

Floreani, Nelson, Karlsen, Petkov, and Richmond disclose other examples of symmetrical skis of various types.

Staufer discloses a symmetrical alpine ski with a series of side cuts along both edges.

In addition to the prior art discussed above, several types of asymmetrical snowboards have been marketed in the past. Snowboard bindings typically hold the rider's feet at a diagonal angle with respect the snowboard. As a result, the center of pressure shifts Slightly forward or rearward as the rider transfers his weight to the right or left edges to turn the snowboard. Some snowboards compensate for this axial shift in the center of pressure by placing the point of maximum side cut on the right side of the board further forward than on the left side, for a right-footed snowboarder. This would be reversed for a left-footed snowboarder.

4. Statement of the Problem

Properly designed skis must accommodate a number of concerns in today's highly competitive market. It is particularly important that the skier should be able to execute turns without undue effort, and that the skis should be stable and easy to control. The prior art listed above has several shortcomings, particularly with regard to telemark skiing:

(a) Asymmetrical Edge Pressure Problem With Existing Snow Skis

In the telemark posture, it is difficult to apply a large amount of pressure on the active edge of the inside ski, because the knee over that ski is bent and contact with that ski is only made by the toe area of the boot. Since there is less pressure on the active edge of the inside ski, it is more difficult to turn that ski. However, in the telemark posture, it is comfortable and easy to apply pressure on the active edge of the outside ski, because the knee over that ski is straighter and the contact with the ski is made by the entire bottom of the boot. Since there is more pressure on the active edge of the outside ski, it is easier to turn that ski.

In the utilization of existing telemark ski equipment in the telemark posture, the amount of pressure on the active edge of the inside ski is significantly less than the amount of pressure on the active edge of the outside ski, owing to the different locations of application of pressure for each of the two skis when a telemark posture is employed. In order to best turn both skis together, it would be ideal if the pressure on each active edge were close to equal. The problem with existing skis is that their design results in a substantial disparity of pressure on the active edges.

(b) The Center of Pressure Problem With Existing Snow Skis

As previously discussed, turns are accomplished on skis by applying pressure on the active edge. The active edge turns the ski by virtue of its shape, which is curved inward toward the center of the ski, as shown for example in FIGS. 4 and 5. Since this curvature is achieved by effectively cutting out the side of the ski, it is known in the ski industry as "side cut". The point along the edge having the greatest side cut can be referred to as "maximum side cut." Maximum side cut can also be defined as the point along the edge that is furthest from an imaginary straight line running between the two ends of the edge.

The center of pressure on a ski is the point underneath the boot denoting the center of downward pressure from the skier onto the ski. On any snow ski, there is a particular point either at maximum side cut, or very close to it, where it is best to have the center of pressure located for optimal turning. Ski manufacturers typically mark that point "boot center", and bindings are mounted on the ski so that the center of pressure is at that point.

Existing snow skis are constructed so that maximum side cut on each edge is located at the same point along the length of the ski on each side. This symmetrical arrangement of maximum side cuts makes sense for alpine skiing, where the boot is fixed in one place. In telemark skiing, due to the telemark posture, there are two different centers of pressure on each ski. One center of pressure is under the middle of the boot sole when the ski is the outside ski and the boot is resting flat on the ski. However, when the ski is the inside ski, the skier's knee is bent so that the heel rises, and the center of pressure shifts forward and is located under the toe area of the boot. Symmetrical maximum side cuts on existing skis are not well-suited for telemark skiing because they are designed as if there were only one center of pressure, This flaw results in the telemark, skier's application of pressure in a location on the inside ski that is not ideal for the physical properties of the curved edge.

(c) Proportional Length Problem With Existing Telemark Skis

Skis are typically designed with predetermined proportions of the ski in front and behind the center of pressure exerted by the skier's boot. For example, many conventional skis are optimal if have approximately 55% of their length is in front of, and approximately 45% is behind the center of pressure. In telemark skiing, the center of pressure for the inside ski shifts forward when turning, as previously discussed. This also shifts the proportion of the ski in front and behind the center of pressure, resulting in less than optimal performance for that ski, and causing a disparity with the proportional lengths of the other ski.

5. Solution to the Problem

The present invention addresses the edge pressure problem discussed above by shortening the active edge of the inside ski. By reducing the length of the active edge receiving less pressure, the lineal force along that active edge is increased so it is brought closer to parity with the lineal force on the active edge of the outside ski. This leads to increased facility and fluidity while turning. In other words, the present invention makes it easier to turn the inside ski by shortening the active edge of that ski.

The present invention also solves the problem of having two centers of pressure in telemark skiing by locating the point of maximum side cut at a point along each edge corresponding to the location of the center of pressure when that edge is the active edge. By locating the point of maximum side cut for each active edge according to that edge's center of pressure, the present invention increases the maneuverability and responsiveness of the skis.

The present invention also solves the proportional length problem associated with conventional telemark skis by using different medial and outer edge lengths.

SUMMARY OF THE INVENTION

This invention provides snow skis having asymmetrical edges to make turning easier. In particular, each ski has concave, curved lateral edges, whereby the medial edge of each ski is substantially longer than its outer edge. In addition, the points of maximum side cut on the ski edges can be asymmetrical with one in front of the other. The point of maximum side cut on the outer edge is generally adjacent to the toe area of skier's boot, while the point of maximum side cut on the medial edge is generally adjacent to the middle of the ski boot to facilitate easier turns while telemark skiing. These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figures 1, 2A, 2B, 3:
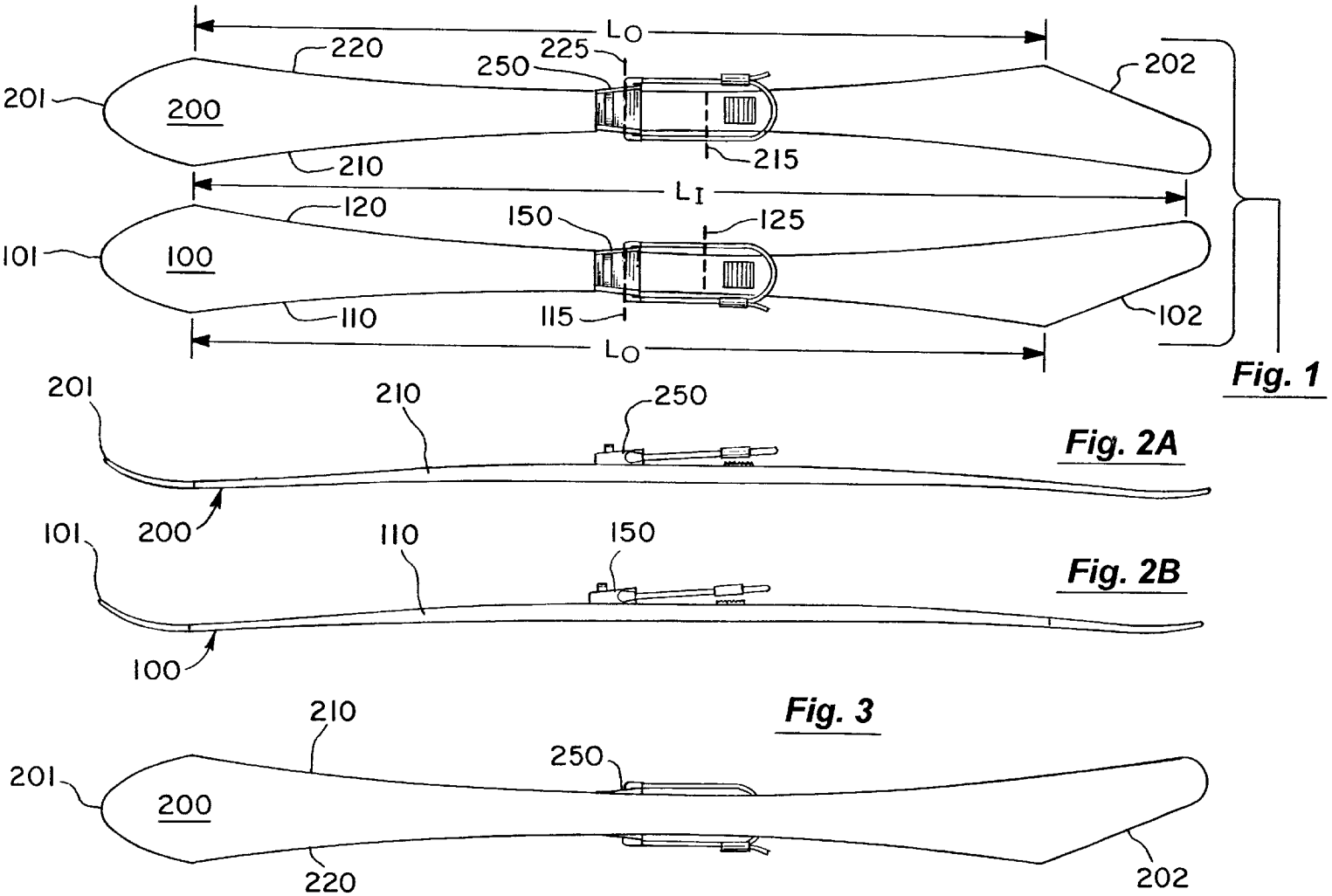
FIG. 1 is a top plan view of a pair of telemark skis embodying the present invention.
FIG. 2A is a side elevational view of the right ski 200 corresponding to FIG. 1.
FIG. 2B is a side elevational view of the left ski 100 corresponding to FIG. 1.
FIG. 3 is a bottom plan view of the right ski 200 corresponding to FIG. 1.

Turning to FIG. 1, a top plan view is presented of a pair of telemark skis 100, 200 embodying the present invention. FIG. 2A is a corresponding side elevational view and FIG. 3 is a corresponding bottom plan view of the right ski 200. FIG. 2B is a side elevational view of the left ski 100 in FIG. 1. Each ski 100, 200 has a front tip 101, 201 and bindings 150, 250 for securing the skier's boots to the skis. Each ski 100, 200 also has a left lateral edge 110, 210 and an opposing right lateral edge 120, 220, respectively.

In the preferred embodiment of the present invention, both left lateral edges of each ski have concave, curved shapes. This is normally referred to as side cut. Although the left ski 100 is typically a mirror image of the right ski 200, it is important to note that these lateral edges are not symmetrical for each ski. In particular, the left edge 110 of the left ski 100 has a length, $L_O$, that is substantially shorter than the length, $L_I$, of its right edge 120. Similarly, the left edge 210 of the right ski 200 has a length substantially longer than that of its right edge 220. Generally, the medial edges 120, 210 of both skis 100, 200 have the same length, $L_I$, and the outer edges 110, 220 of both skis have the same length, $L_O$, which is substantially shorter than $L_I$. In the preferred embodiment of the present invention, the outer edges 110 and 220 have a length, $L_O$, that is approximately 2 to 14 inches shorter than the length, $L_I$, of the medial edges 120, 210.

It should be expressly understood that the lateral edges of the skis 110, 120, 210, and 220 are determined not by the part of the ski that has metal edges, but instead by the curved (i.e., side cut) portion of the side of the ski used for turning. The ends of the lateral edges 110, 120, 210, and 220 are determined by the point at which the side of the ski substantially departs from a concave curve and turns back inward toward the opposing lateral edge. The radius of curvature of the outer edges 110, 220 can either be equal or less than the radius of curvature of the medial edges 120, 210. In contrast, the length of each edge is measured along a line extending parallel to the longitudinal axis of the ski (i.e., $L_I$ or $L_O$) as shown in FIG. 1. In addition, it should be noted that an edge does not necessary have a uniform curvature over its entire length and could have relatively straight portions, particularly near the area of maximum side cut.

The tips 101, 201 of the skis are typically symmetrical about the longitudinal axis of each ski for greater stability, although asymmetrical tips are possible. As shown in the side elevational views provided in FIGS. 2A and 2B, the tips 101 and 201 curve upward to help the skis ride over the surface of the snow. In the preferred embodiment, both the left and right medial edges of the ski begin at substantially the same distance behind the tip of the ski, as illustrated in FIG. 1. However, the longer length of the medial edge 120, 210 results in an asymmetrical tail section 102, 202 for each ski. One possible configuration of the tail section 102, 202, depicted in FIGS. 1 and 3, extends diagonally inward from the trailing end of the outer edge 110, 220 toward the trailing end of the medial edge 120, 210 for each ski. Alternatively, the tail section 102, 202 could be rounded or have any other suitable contour connecting the trailing end of the medial edge 120, 210 with the trailing end of the outer edge 110, 220 of the ski. Each ski typically has a tail section 102, 202 that is a mirror image of the other ski's tail section.

Figure 4:
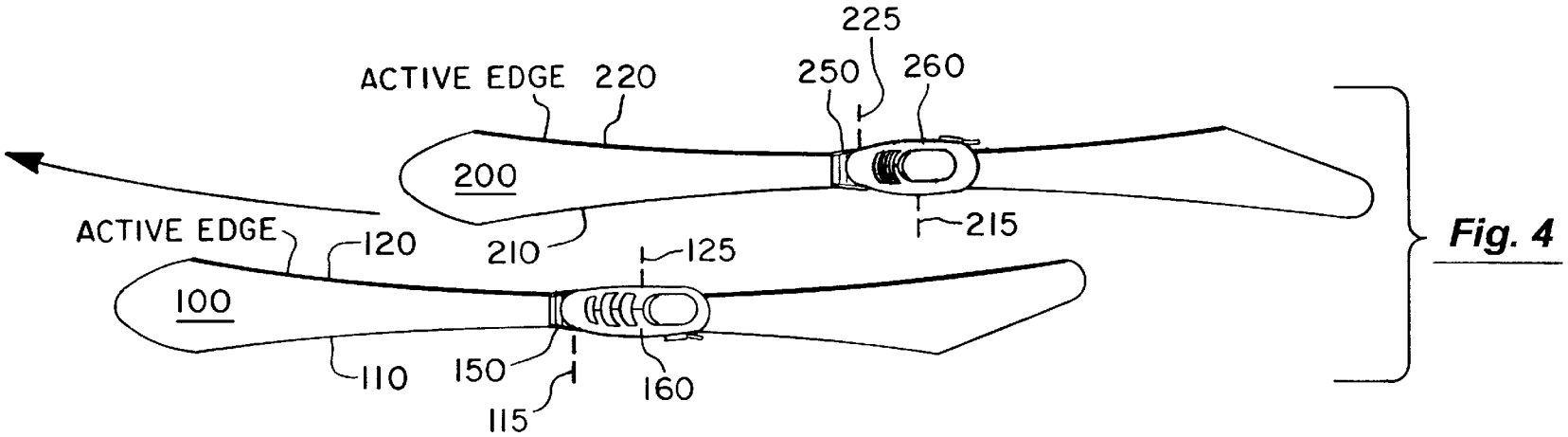
FIG. 4 is a top plan view of a pair of telemark skis in a right turn.
Figure 5:
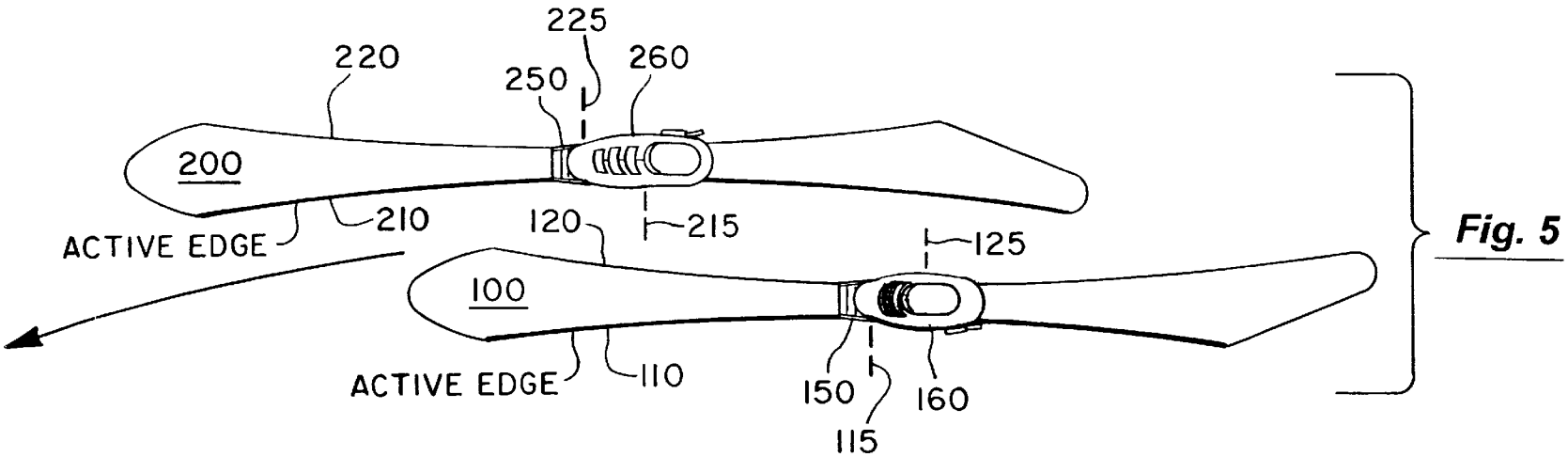
FIG. 5 is a top plan view of a pair of telemark skis in a left turn.

When the present invention is used in telemark skis as shown in FIGS. 1, 4 and 5, the points of maximum side cut on the medial and outer edges relative to the binding 150, 250 and the skier's boot 160, 260 are significantly different. Please note that the point of maximum side cut 115 on the left edge 110 of the left ski 100 is generally adjacent to the toe area of the skier's left boot 160. Similarly, the point of maximum side cut 225 on the right edge 220 of the right ski 200 is generally aligned with the toe area of the skier's right boot 260. In contrast, the point of maximum side cut 125 on the right edge 120 of the left ski 100 is adjacent to the middle of the skiers left boot 160, and the point of maximum side cut 215 on the left edge 210 of the right ski 200 is adjacent to the middle of the skier's right boot 260. Thus, the locations of the points of maximum side cut correspond to the shifting of the center of pressure exerted by the telemark skier's boot 160, 260 while turning, as will be discussed in greater detail below. The distance between these points of maximum side cut as measured along the longitudinal axis of the ski is in the range of approximately 1 to 10 inches in the preferred embodiment of the present invention.

FIG. 4 is a top plan view of a pair of telemark skis 100, 200 in a right turn, and FIG. 5 is a corresponding top plan view of a left turn. To execute a turn, the skier positions the inside ski behind the outside ski, so that the heel of the inside boot is raised off the inside ski. Any pressure applied by the skier to the inside ski is exerted via the toe area of the boot. In contrast, the outside boot remains flat against the outside ski, so that pressure is exerted over the entire area of the ski boot. The active or turning edges are the medial edge of the outside ski and the outer edge of the inside ski, as shown in bold lines in FIGS. 4 and 5.

The present invention recognizes and accommodates this difference in the centers of pressure for the inside and outside skis by aligning the point of maximum side cut 115, 225 on the outer edge of the inside ski with the toe area of the inside boot, while the point of maximum side cut 125, 215 on the medial edge of the outside ski is adjacent to the middle of the outside boot. In other words, the point of maximum side cut 115, 225 on the outer edge of each ski is in front (i.e., closer to the ski tip) of the point of maximum side cut 125, 215 on its medial edge. This configuration enables the center of pressure for each ski to remain aligned with the point of maximum side cut (i.e., center of curvature) for the active or turning edge for that ski, thereby providing greater stability and ease of turning.

More specifically, please consider the right turn illustrated in FIG. 4. The right ski 200 is the inside ski, while the left ski 100 is the outside ski in the turn. The skier positions the right ski 200 behind the left ski 100, so that the right knee is bent and the heel of the right boot is raised off the right ski 200. The active edges are the right edges 120, 220 of both skis 100, 200. Any pressure applied by the skier to the right ski 200 is exerted via the toe area of the boot, which is adjacent to the point of maximum side cut 225 on the right edge 220 of the right ski 200. In contrast, the left boot remains flat against the left ski 100, so that pressure is exerted over the entire area of the left ski boot. The point of maximum side cut 125 on the right edge 120 of the left ski 100 is adjacent to the middle of the skier's left boot.

Similarly, in the left turn depicted in FIG. 5, the skier positions the left ski 100 behind the right ski 200, so that the left knee is bent and the heel of the left boot is raised off the left ski 100. The right boot remains flat against the right ski 200. The active edges are the left edges 110, 210 of both skis 100, 200. The point of maximum side cut 115 on the left edge 110 of the left ski 100 is adjacent to the toe area of a skier's left boot. In contrast, the point of maximum side cut 215 on the left edge 210 of the right ski 200 is adjacent to the middle of the skier's right boot.

Figure 6:
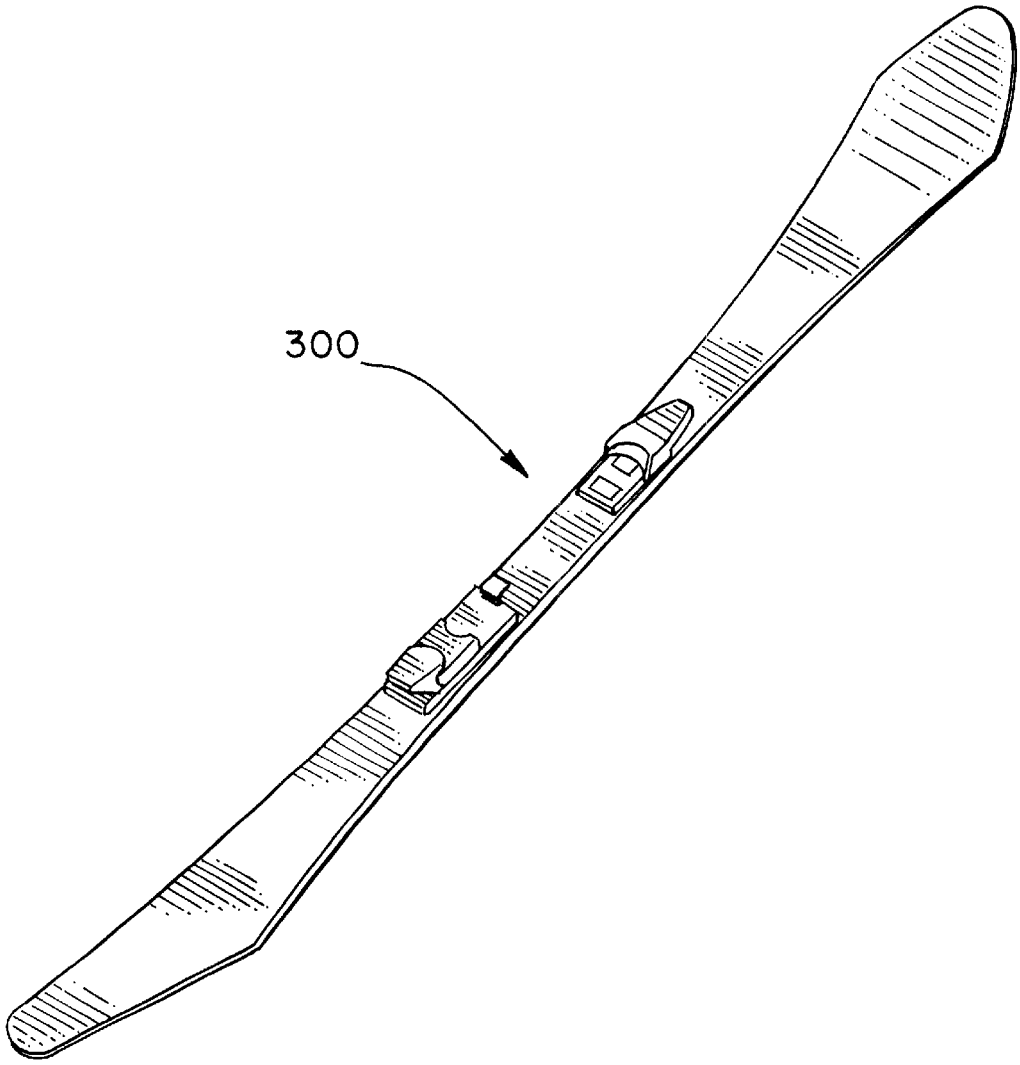
FIG. 6 is a front perspective view of a right alpine ski embodying the present invention.

FIGS. 1 through 5 illustrate the present invention used in telemark skis. It should be expressly understood that the present invention could be applied to other types of skis, such as alpine, randonée, and cross-country skis. For example, FIG. 6 is a front perspective view of a right alpine ski 300 embodying that aspect of the present invention relating to different edge lengths. In alpine skiing, the inside or medial edge of the outside ski is used for turning. For example, in a left turn, pressure is applied to the left edge of the right ski. The ideal in alpine skiing is to place nearly all of the skier's weight and pressure on that active edge. In a left turn, the right edge of the right ski is not used. By reducing the length of this superfluous edge, the present invention causes the skis to be lighter. Lighter skis are easier to maneuver and quicker to place on edge.

In addition, the outer edge of the inside ski (e.g., the left edge of the left ski in a left turn) must make a tighter-radius turn if the inside ski is to remain parallel with the outside ski. This is made more difficult by the fact that only a minimal amount of pressure is normally applied to the inside ski. Here again, the present invention addresses these concerns by reducing the length of the outer edge of the inside ski, thereby increasing the lineal force on that edge, making it easier to perform shorter-radius turns.

The above disclosure sets forth a number of embodiments of the present invention. Other arrangements or embodiments, not precisely set forth, could be practiced under the teachings of the present invention and as set forth in the following claims.

I claim:

1. A snow ski to be worn primarily on a ski boot, said snow ski comprising:

a concave, curved, outer edge; and a concave, curved, medial edge having a length substantially longer than said outer edge, wherein said outer edge has a point of maximum side cut approximately 1 to 10 inches in front of the point of maximum side cut of said medial edge.

2. The snow ski of claim 1 wherein said outer edge has a point of maximum side cut substantially adjacent to the toe area of the ski boot.

3. The snow ski of claim 1 wherein said medial edge has a point of maximum side cut substantially adjacent to the middle of the ski boot.

4. The snow ski of claim 1 wherein said ski comprises a telemark ski.

5. The snow ski of claim 1 wherein said ski comprises an alpine ski.

6. The snow ski of claim 1 wherein said ski comprises a randonée ski.

7. The snow ski of claim 1 wherein said ski comprises a cross-country ski.

8. The snow ski of claim 1 further comprising an asymmetrical tail section extending from the trailing end of said outer edge to the trailing end of said medial edge.

9. The snow ski of claim 1 wherein said outer edge has a length approximately 2 to 14 inches shorter than said medial edge.

10. A pair of snow skis primarily to be worn on ski boots, each ski comprising:

an outer edge with a side out forming a concave, curved edge having a point of maximum side cut; and a medial edge with a side cut forming a concave, curved edge having a point of maximum side cut;

wherein said point of maximum side cut of said outer edge is in front of said point of maximum side cut of said medial edge.

11. The snow skis of claim 10 wherein said medial edge has a length substantially longer than said outer edge.

12. The snow skis of claim 10 wherein said skis comprise telemark skis.

13. The snow skis of claim 10 wherein said skis comprise alpine skis.

14. The snow skis of claim 10 wherein said skis comprise randonée skis.

15. The snow skis of claim 10 wherein said skis comprise cross-country skis.

16. The snow skis of claim 10 wherein at least one of said skis further comprises an asymmetrical tail section extending from the trailing end of said outer edge to the trailing end of said medial edge.

17. A pair of snow skis, each of the snow skis comprising:

an outer edge;

the outer edge ending at an outer edge rearward end point;

the outer edge beginning at a outer edge forward beginning point;

a medial edge;

the medial edge ending at a medial edge rearward end point;

the medial edge beginning at a medial edge forward beginning point;

the outer edge beginning point being substantially planer with the medial edge beginning point; and the outer edge rearward end point being in front of the medial edge rearward end point.

18. The pair of snow skis according to claim 17 wherein, a length of the outer edge is shorter than a length of the medial edge.

19. The pair of snow skis according to claim 17 wherein, the outer edge comprises at least one substantially curved portion.

20. The pair of snow skis according to claim 17 wherein, the outer edge comprises at least one linear portion.

21. The pair of snow skis according to claim 17 further comprising:

a tail portion; and the tail portion being connected to the outer edge rearward end point and the medial edge rearward end point, wherein the outer edge rearward end point being in front of the medial edge rearward end point causing the tail portion to be asymmetrical.

22. The pair of snow skis according to claim 17 wherein, the outer edge comprises at least one point of outer maximum side cut; and the medial edge comprises at least one point of medial maximum side cut.

23. The pair of snow skis according to claim 22 wherein, at least a portion of the at least one point of outer maximum side cut is in front of at least a portion of the at least one point of medial maximum side cut.

24. The pair of snow skis according to 19 wherein, at least one point of outer maximum side cut comprises at least one of a plurality of points along the at least one substantially curved portion of the outer edge.

25. The pair of snow skis according to claim 20 wherein, at least one point of outer edge maximum side cut comprises at least one of a plurality of points along the at least one substantially linear portion of the outer edge.

26. The pair of snow skis according to claim 23 wherein, the at least one point of outer edge maximum side cut is forward of the at least one point of inner edge maximum side cut by no more than about 10 inches.

27. The pair of snow skis according to claim 23 wherein, the at least one point of outer edge maximum side cut is forward of the at least one point of outer edge maximum side cut by at least about 1 inch.

28. The pair of snow skis according to claim 17 wherein, the pair of snow skis comprise telemark skis.

29. The pair of snow skis according to claim 17 wherein, the pair of snow skis comprise alpine skis.

30. The pair of snow skis according to claim 17 wherein, the pair of snow skis comprise randonée skis.

31. The pair of snow skis according to claim 17 wherein, the pair of snow skis comprise cross-country skis.

32. A snow ski, the snow ski comprising:

a medial edge and an outside edge;

the medial edge being a first length having a first median point substantially halfway along the first length;

the outside edge being a second length having a second median point substantially halfway along the second length; and the second median point is in front of the first median point.

33. The snow ski according to claim 32 wherein:

the outside edge is substantially concave.

34. The snow ski according to claim 33 wherein:

the outside edge comprises at least one linear portion.

35. The snow ski according to claim 33 wherein the outside edge comprises at least one curved portion.

36. The snow ski according to claim 32 wherein:

the medial edge ends in a medial edge rearward end point; and the outside edge ends in an outside edge rearward end point, such that the outside edge rearward end point is in front of the medial edge rearward end point.

37. The snow ski according to claim 36 further comprising:

a tail portion defined by the medial edge rearward end point and the outside edge rearward end point, such that the tail portion is asymmetrical.

38. The snow ski according to claim 32 wherein the medial edge has at least one point of medial edge maximum side cut;

the outside edge has at least one point of outside edge maximum side cut; and the at least one point of outside edge maximum side cut is in front of the at least one point of medial edge maximum side cut.

39. The snow ski according to claim 38 wherein:

the at least one point of outside edge maximum side cut has at least one portion that is at least 1 inch in front of the at least one point of medial edge maximum side cut.

40. The snow ski according to claim 38 wherein:

the at least one point of outside edge maximum side cut has at least one portion that is no more than 10 inches in front of the at least one point of medial edge maximum side cut.

41. The snow ski according to claim 40 wherein:

the at least one portion is also at least 1 inch in front of the at least one point of medial edge maximum side cut.

42. The snow skis according to claim 32 wherein, the snow skis comprise telemark skis.

43. The snow skis according to claim 32 wherein, the snow skis comprise alpine skis.

44. The snow skis according to claim 32 wherein, the snow skis comprise randonée skis.

45. The snow skis according to claim 32 wherein, the snow skis comprise cross-country skis.

46. A pair of snow skis, each ski comprising:

an outer edge and a medial edge;

the outer edge comprising a side cut with an outer maximum side cut; and the medial edge comprising a side cut with a medial maximum side cut, wherein the outer maximum side cut is in front the medial maximum side cut.

47. The pair of snow skis according to claim 46 wherein, the outer edge comprises at least one substantially concave portion; and the medial edge comprises at least one substantially concave portion.

48. The pair of snow skis according to claim 47 wherein, the outer edge comprises at least one substantially curved portion; and the medial edge comprises at least one substantially curved portion.

49. The pair of snow skis according to claim 47 wherein, the outer edge comprises at least one substantially linear portion; and the medial edge comprises at least one substantially linear portion.

50. The pair of snow skis according to claim 46 wherein, the outer edge is substantially shorter than the medial edge.

51. The pair of snow skis according to claim 48 wherein, at least a portion of the outer maximum side cut and the medial maximum side cut reside on curved portions of the outer edge and the medial edge.

52. The pair of snow skis according to claim 49 wherein, at least a portion of the outer maximum side cut and the medial maximum side cut resides on linear portions of the outer edge and the medial edge.

53. The pair of snow skis according to claim 46 wherein, each ski comprises at least one of a telemark ski, an alpine ski, a randonée ski, and a cross-country ski.

54. A pair of snow skis, each ski comprising:

an outer edge and a medial edge;

the outer edge comprising a side cut with an outer maximum side cut portion;

the outer maximum side cut portion having an outer maximum side cut length;

the medial edge comprising a side cut with a medial maximum side cut portion; and the medial maximum side cut portion having a medial maximum side cut length, wherein a median of the outer maximum side cut length is in front of a median of the medial maximum side cut length.

55. The pair of snow skis according to claim 54 wherein, the outer edge comprises at least one substantially concave portion; and the medial edge comprises at least one substantially concave portion.

56. The pair of snow skis according to claim 54 wherein, the outer maximum side cut portion is along at least a part of a substantially linear portion of the outer edge; and the medial maximum side cut portion is along at least a part of a substantially linear portion of the medial edge.

57. The pair of snow skis according to claim 54 wherein, the outer maximum side cut portion is along at least a part of a substantially curved portion of the outer edge; and the medial maximum side cut portion is along at least a part of a substantially curved portion of the medial edge.

58. The pair of snow skis according to claim 54 wherein, the outer edge is substantially shorter than the medial edge.

59. The pair of snow skis according to claim 54 wherein, each ski comprises at least one of a telemark ski, an alpine ski, a randonée ski, and a cross-country ski.

* * * * *